US006228551B1

(12) United States Patent
Ohmura et al.

(10) Patent No.: US 6,228,551 B1
(45) Date of Patent: May 8, 2001

(54) TONER FOR DEVELOPING ELECTROSTATIC IMAGE

(75) Inventors: Ken Ohmura; Tomomi Oshiba, both of Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/469,383

(22) Filed: Dec. 22, 1999

(30) Foreign Application Priority Data

Dec. 24, 1998 (JP) ..... 10-367640

(51) Int. Cl.[7] ..... G03G 9/097
(52) U.S. Cl. ..... 430/110; 430/111
(58) Field of Search ..... 430/106, 110, 430/111

(56) References Cited

U.S. PATENT DOCUMENTS

| | | | | |
|---|---|---|---|---|
| 5,424,162 | * | 6/1995 | Kohri et al. | 430/110 |
| 5,814,428 | * | 9/1998 | Kido et al. | 430/111 |
| 5,824,446 | * | 10/1998 | Nishihara et al. | 430/110 |
| 5,935,751 | * | 8/1999 | Matsuoka et al. | 430/110 |

* cited by examiner

*Primary Examiner*—John Goodrow
(74) *Attorney, Agent, or Firm*—Cantor Colburn LLP

(57) ABSTRACT

A toner for developing an electrostatic image is disclosed. The toner comprises a colored particle containing a binder resin, a colorant, and a low molecular weight polypropylene particle, which has a content of the low molecular weight polypropylene particle of 0.3 to 8.0 percent by weight, a free polypropylene index measured by a centrifugal method of from 0.1 to 0.7 and a free polypropylene index measured by a natural sedimentation method of not more than 0.1.

18 Claims, No Drawings

TONER FOR DEVELOPING ELECTROSTATIC IMAGE

FIELD OF THE INVENTION

This invention relates to a toner for developing an electrostatic image, particularly relates to a toner comprising particles of low molecular weight polypropylene.

BACKGROUND OF THE INVENTION

In an example of image formation process in the electrophotographic method, an electrostatic image is formed on a photoreceptor by giving uniformly charge and imagewise exposure thereto. The electrostatic image is developed by a developer containing a toner to form a toner image, and the toner image is transferred to a paper and fixed to form a visual image. On the other hand, a cleaning member arranged on the surface of photoreceptor so as to be contacted with pressure to the surface removes the toner which is not transferred to the paper and remained on the photoreceptor.

In the fixing process of such the image forming procedure, the fixing image is usually formed by the use of a heat-roller fixing device.

There is a drawback in the fixing by the heat-roller device that an offset problem tends to raise. The offset problem is caused by transferring a part of the molten toner to the surface of the heat-roller, the transferred toner is transferred back to the next paper so as to contaminate the image.

A technique has been known to prevent the offset problem, in which a particle of low molecular weight polypropylene is contained in the colored particle for giving a mold-releasing ability of the toner.

The low molecular weight polypropylene particle has a high mole-releasing ability itself and is able to be sharply fused when the particle is heated. Therefore, when the toner comprising such the colored particle is used, the low molecular weight polypropylene particle is rapidly fused at the fixing treatment by the heat-roller and the surface of the toner particle is covered by the fused low molecular weight polypropylene. As a result of that, the interface energy between the toner particle and the surface of heat-roller is lowered and the mold releasing ability of the toner is made higher.

However, a part of the low molecular weight polypropylene particles can not be included in the colored particles since the miscibility of the low molecular weight polypropylene particle with the binder resin of the colored particle is not so high. Accordingly, low molecular weight polypropylene particles freely existing outside the colored particles, hereinafter referred to free polypropylene particle, are formed.

When the toner containing the free polypropylene particles is used in the image forming process, problems are raised such as that the charging ability of the toner is made unstable and toner filming on the photoreceptor tends to be formed.

Moreover, a problem that a black spot like contamination is formed on the image when the diameter of the free polypropylene particle is large.

Furthermore, a problem is raised that the presence of the free polypropylene particles causes lowering in the flowing ability of the toner and the life of the developer is shortened.

On the other hand, when a toner with no free polypropylene particle or a wax-free toner is used in the image forming process, a sufficient transferring ability cannot be obtained since the particles are not present which fill the role of spacer for lowering the adhesive force between the toner particle and the photoreceptor.

SUMMARY OF THE INVENTION

The object of the invention is to provide a toner by which the offset problem and the toner film formation on the photoreceptor can be inhibited while maintaining a high transferring ability in the image forming process.

The toner of the invention comprises a colored particle containing at least a binder resin, a colorant, and a low molecular weight polypropylene particle, which has a content of the low molecular weight polypropylene particle of from 0.3 to 8.0 percent by weight based on the toner, a free polypropylene index measured by a centrifugal method of from 0.1 to 0.7 and a free polypropylene index measured by a natural sedimentation method of not more than 0.1.

It is preferable in the toner that the shape of the polypropylene particle separated by the centrifugal method is substantially ellipsoid. It is also preferable a number ratio of ellipsoid polypropylene particles each having an elliptical axis ratio of projection image of not more than 0.8 to the whole number of the separated polypropylene particles is not less than 50 percent.

It is preferable in the toner that the ratio of the number of the particles each having a particle diameter of not more than 4 $\mu$m present in the polypropylene particles separated by the centrifugal method to the whole number of the polypropylene particles separated by the centrifugal method is not less than 50%, more preferably not less than 60%.

DETAILED DESCRIPTION OF THE INVENTION

The invention is described in detail bellow.

Toner

The toner of the invention comprises colored particles and an external additive added according to necessity, and the colored particle comprises a binder resin, a colorant and a mold releasing agent, or low molecular weight polypropylene particle, in which an internal additive may be added according to necessity.

(1) Binder resin

A binder resin usually used in toner, such as a styrene resin, an acryl resin, a styrene/acryl resin and a polyester resin, is usable for the binder resin of the toner of the invention.

(2) Colorant

A colorant usually used in toner, such as carbon black, a magnetic material, a dye and a pigment, is usable for the colorant of the toner.

Examples of the carbon black usable as the colorant include channel black, furnace black, acetylene black, thermal black and lump black.

Examples of the magnetic substance include a ferromagnetic metal such as iron, nickel and cobalt, an alloy containing such the metal, a compound of a ferromagnetic metal such as ferrite and magnetite, a ferromagnetic alloy by a heat treatment even though containing no ferromagnetic metal such as a kind of alloy called Heuslar alloy such as manganese-copper-aluminum and manganese-copper-tin, and chromium dioxide.

As the dye, for example, C.I. Solvent Red series of 1, 49, 52, 58, 63, 111, and 122, C.I. Solvent Yellow series of 19, 44, 77, 79, 81, 82, 93, 98, 103, 104, 112 and 162, and C.I. Solvent Blue series of 25, 36, 60, 70, 93 and 95, are usable. A mixture of them may also be used.

Examples of the pigment include C.I. Pigment Red series of 5, 48:1, 53:1, 57:1, 122, 139, 144, 149, 166, 177, 178 and 222, C.I. Pigment Orange series of 31 and 43, C.I. Pigment Yellow series of 14, 17, 93, 94 and 138, C.I. Pigment Green 7, C.I. Pigment Blue series of 15:3 and 60. These pigments may be used singly or in combination.

Examples of preferred colorant include carbon black, Nigrosine dye, aniline blue, chalcoil blue, chrome yellow, ultramarine blue, du Pont oil red, quinoline yellow, methylene blue chloride, phthalocyanine blue, malachite green oxalate and rose bengal.

(3) Mold releasing agent

A low molecular weight polypropylene particle is used as the mold-releasing agent for the toner. A low molecular weight polypropylene particle synthesized by using a metallocene catalyst may be used as such the low molecular weight polypropylene particle.

The molecular weight of the low molecular weight polypropylene particle is preferably from 1,500 to 10,000, particularly from 1,800 to 4,000, in number average molecular weight Mn.

The number average molecular weight Mn is a number average molecular weight Mn measured by a high temperature GPC method. In concrete, the number average molecular weight is determined by a procedure in which a sample is flowed out at 135° C. using o-dichlorobenzene containing 0.1% of ionol and the refractive index thereof is measured by a difference refractive index meter and converted by polypropylene absolute molecular weight conversion according to the universal compensation method.

Heat energy necessary for fusing the toner can be lowered when the number average molecular weight Mn of the low molecular weight polypropylene particle is within the range of from 1,500 to 10,000, with the result that the toner fixable at a relative low temperature can be prepared.

The toner containing the low molecular weight polypropylene particle is excellent in the storage ability and fixing ability since of the low molecular weight polypropylene particle has a narrow molecular weight distribution.

The ratio of the weight average molecular weight Mw to the number average molecular weight Mn of the low molecular weight polypropylene particle Mw/Mn is preferably from 1.5 to 3, particularly from 2 to 3. When the ratio is within the range of from 1.5 to 3, the viscosity of the fused polymer is sufficiently lowered and the problem is effectively inhibited.

The content of the low molecular weight polypropylene particles in the toner of the invention is within the range of from 0.3 to 8.0% by weight, preferably 1.3 to 5.7%, more preferably 1.9 to 3.8% by weight of the toner.

When the content of low molecular weight polypropylene particles is less than 0.3% by weight, the mold releasing ability of the toner is become insufficient and the offset tends to occur when the toner is used in the image forming process.

On the other hand, when the content of the low molecular weight polypropylene particles exceeds 8.0% by weight, a large number of free low molecular weight polypropylene particles are formed and the toner film tends to be formed on the surface of the photoreceptor when the toner is used in the image forming process.

(4) Additive (a) Internal additive:

Examples of internal additive to be added in the toner include a negative charge controlling agent such as an azo metal complex, a salicylic metal complex and a calixarene compound, a positive charge controlling agent such as a Nigrosine dye and a quaternary ammonium salt, a fixing ability improving agent such as a low molecular weight polyolefin and Carnauba wax, and a magnetic particles to be used in a magnetic toner. Examples of magnetic particle include a particle of ferrite and magnetite each having an average diameter of primary particles of from 0.1 to 2.0 μm. The content of the magnetic particles is from 20 to 70% by weight of the colored particle.

(b) External additive:

As an external additive, or an optional component of the colored particle, contained in the toner of the invention, an inorganic and organic fine particle may be used, and the inorganic fine particle is preferably used for giving a flowing ability to the colored particle.

Various inorganic oxide compounds such as nitride compounds and boron compounds may be use for forming the inorganic fine particle. Concrete examples of the inorganic compound include silica, alumina, titania, zirconia, barium titanate aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, titanium carbide, boron carbide, silica nitride, titanium nitride and boron nitride.

The number average primary particle diameter is preferably from 5 to 200 nm, which is determined by analysis of the image observed by a transparency-type electronic microscope.

The surface of such the inorganic fine particle is preferably subjected to a treatment to give hydrophobic property by a coupling agent such as a titanium coupling agent and silane coupling agent, or silicone oil.

As the titanium coupling agent, tetrabutyl titanate, tetraoctyl titanate, isopropyltriisostearoyl titanate, isopropyltridecylbenzenesulfonyl titanate, and bis(dioctyl pyrophosphate) oxyacetate titanate are usable.

As the silane coupling agent, the followings are usable; γ-(2-aminoethyl) aminopropyltrimethoxysilane, γ-(2-aminoethyl) aminopropyldimethoxysilane, γ-methacryloxypropyltrimethoxysilane, N-β-(N-vinylbenzylaminoethyl) γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecytrimethoxysilane, phenyltrimethoxysilane, o-methylphenyltrimethoxysilane and p-methylphenyltrimethoxysilane.

As the silicone oil, dimethylsilicone oil, methylphenylsilicone oil and amino-modified silicone oil are usable.

The particle diameter of the colored particle of the toner of the invention is preferably within the range of from 2 to 10 μm, more preferably 3.0 to 9.0 μm, in a volume average diameter measured by Coulter Counter TA-11 or Coulter Multisizer. The diameter of the colored particle can be controlled by production conditions thereof. Preferably, the colored particles contain the polypropylene having a diameter of 0.1 to 0.8 μm, more preferably 0.3 to 0.8 μm.

(5) Free polypropylene index

In the toner of the invention, the free polypropylene index measured by the centrifugal separation method is within the range of from 0.1 to 0.7, preferably 0.1 to 0.5, more preferably 0.1 to 0.4, and the free polypropylene index measured by the natural sedimentation method is not more than 0.1, preferably not more than 0.05.

(5-1) Free polypropylene index measured by the centrifugal separation method

In the invention, "free polypropylene index measured by the centrifugal separation method" is a light absorbency or turbidity of the top clean liquid obtained by centrifugal separation of a suspension of the toner. In concrete, the light absorbency at 500 nm of the top clean liquid obtained by the following procedures (I) to (iv).

(i) Preparation of a surfactant solution:

A suitable amount of water is put in a measuring flask of 100 ml and 1 ml of a 12% solution of sodium dodecylbenzenesulfonate is added, then water is gently added to make the volume of the solution to 100 ml to prepare a surfactant solution.

(ii) Preparation of toner suspension

In a bottle of 50 ml with screw stopper, 15 g of toner is put, and 30 ml of the surfactant solution prepared in (i) is gently added. The bottle is closed by a stopper and the shook for 1 minute by hand to prepare a suspension of the toner.

(iii) Centrifugal separation

The suspension of toner is put into a 50 ml separation tube and the tube set in an angle rotor having a rotating radius of 70 mm. Then the suspension is subjected to the centrifugal separation for 20 minutes at 5000 rpm.

(iv) Separation of top clean liquid

The low molecular weight polypropylene particles adhered on the internal wall of the centrifuge tube are washed off from the wall by the top clean liquid using a pipette and the top clean liquid is sampled. If the precipitated toner particles are mixed in the top clean liquid, the liquid is stood for one day in the tube or subjected to the centrifugal separation once more.

(5-2) Free polypropylene index measured by the natural sedimentation method

In the invention, "free polypropylene index measured by the natural sedimentation method" is a light absorbency or turbidity of the top clean liquid obtained by natural sedimentation of a suspension of the toner. In concrete, the light absorbency at 500 nm of the top clean liquid obtained by the following procedures (I) to (iii).

(i) Preparation of a surfactant solution:

A suitable amount of water is put in a measuring flask of 100 ml and 1 ml of a 12% solution of sodium dodecylbenzenesulfonate is added, then water is gently added to make the volume of the solution to 100 ml to prepare a surfactant solution.

(ii) Preparation of toner suspension

In a bottle of 50 ml with screw stopper, 15 g of toner is put, and 30 ml of the surfactant solution prepared in (i) is gently added. The bottle is closed by the stopper and shook for 1 minute by hand, until the aggregation of toner can not be found by eyes view, as a guideline, to prepare a suspension of the toner.

(iii) Separation of top clean liquid

The toner suspension is stood for one day and the top clean liquid is sampled by a pipette.

When the free polypropylene index measured by centrifugal separation method is not less than 0.1, a suitable amount of free polypropylene particles is fixed on the surface of the toner particle with a suitable adhesive force with the result that a high transferring ability of the toner can be obtained.

Moreover, when the free polypropylene index measured by natural sedimentation method is not more than 0.1 and the free polypropylene index measured by centrifugal separation method is not more than 0.7, the charging ability of the toner can be stabilized with the result that the formation of toner film on the photoreceptor can be inhibited.

(6) Shape of the free polypropylene particle separated by the centrifugal method It is preferred in the toner of the invention that the shape of the free polypropylene particle separated by the centrifugal method is substantially ellipsoid and that the number of the free polypropylene particles having a elliptical ratio (shorter axis/longer axis) of the projection image of the ellipsoid of not more than 0.8 accounts not less than 50% of the number of the whole free polypropylene particles.

The elliptical ratio of the free polypropylene particles separated by the centrifugal method can be determined by the following procedures: a white turbid part floating at the surface the top clean liquid is sampled after the centrifugal separation according to the above (5-1) (iii); the sampled portion is filtered to obtained a white powder; the white powder is subjected to IR measurement to confirm that the powder is polypropylene; the microscopic image of the powder is taken by a scanning electron micrometer T-330, (manufactured by Nihon Denshi Co., Ltd., acceleration potential: 20 kV, Spot size: 3 p.m. o'clock-set, in gamma intensifying mode); and the images of 2000 particles are subjected to image analyzing by an image analyzer SIA, manufactured by Nihon Denshi Co., Ltd.

When the number ratio of the free polypropylene particles each having an elliptical ratio of not more than 0.8 is not less than 50%, the charging ability of the toner can be stabilized with the result that the formation of toner film on the photoreceptor can be inhibited when the toner is used in the image forming process.

(7) Volume average diameter of the free polypropylene particles separated by the centrifugal method In the toner of the invention, it is preferred that the ratio of the free polypropylene particles separated by the centrifugal method having diameter of not more than 4 $\mu$m is not less than 50%, more preferably not less than 60%, in number of the whole polypropylene particles by the centrifugal method.

The volume average diameter of the free polypropylene particles can be measured by subjecting the free polypropylene particles in the top clean liquid obtained by the procedure of the above (5-1) (iv) to measure by Coulter Multisizer manufactured by Coulter Co., Ltd.

The transferring ability of the toner can be stabilized when the free polypropylene particle each having a diameter of not more than 4 $\mu$m are existed in a ratio of not less than 50% in number.

(8) Producing method of the toner

The toner of the invention can be prepared by either a crushing method or a polymerization method. The crushing method is preferred.

In the crushing method, a raw composition of the toner containing raw materials such as the binder resin, the coloring agent, the mold releasing agent, or the low molecular weight polypropylene particles, and the charge controlling agent, is molten, kneaded, crushed and classified to prepare the colored particles. The crushing and classifying processes may be repeated when it is necessary. The external additive is added to the colored particles to prepare the toner.

In the above, the diameter of the low molecular weight polypropylene particle is preferably within the range of from 0.1 to 100 $\mu$m, more preferably from 0.3 to 6 $\mu$m.

The shape of the low molecular weight polypropylene particles is preferably ellipsoid or spindle-shape.

The low molecular weight polypropylene particles each having the above-mentioned diameter and shape can be produced by controlling the diameter and the shape by a solution sedimentation process and a heat treatment, respectively.

The solution sedimentation process is a method in which the low molecular weight polypropylene particles are dissolved in toluene under reflux and the solution is cooled to 50° C. Then the solution is poured into cold acetone. Thus the low molecular weight polypropylene particles each having a diameter within a specified range.

The shape of the low molecular weight polypropylene particle can be made such as the spindle-shape by putting the particle in heated air blow. In such the case, the temperature of the air blow is preferably from 100 to 140 C. When the temperature is excessively high, the shape of the low molecular weight polypropylene particles tends to be made not uniform. The heat treatment may be carried out in a liquid.

As is mentioned above, the free propylene index by centrifugal method is within the range of from 0.1 to 0.7 and the free polypropylene index by natural sedimentation method is not more than 0.1 in the toner of the invention, with the result that the occurrence of toner-filming can be inhibited while maintaining a sufficiently high transferring ability when the toner is used in the image forming process.

In the toner of the invention, the occurrence of toner-filming can be inhibited when the shape of the free polypropylene particle the centrifugal method is substantially ellipsoid and the ratio of the particles each having a elliptical ratio of the ellipsoid of not more than 0.8 account not less than 50% in number of the whole free polypropylene particles.

Moreover, a sufficiently high transferring ability in the image forming process can be obtained when the ratio of the number of the free polypropylene particles the centrifugal method having a diameter on not more than 4 $\mu$m to the whole number of free polypropylene particles is not less than 50%.

Developer

The toner according to the invention can be used in any embodiment such as (1) singly use as a magnetic toner containing a magnetic substance, (2) singly use as a non-magnetic toner containing no magnetic substance and (3) use as a two-component developer together with a carrier. Among them the embodiment (3) is preferred.

As the carrier to be mixed with the toner, both of (1) a carrier composed of only a magnetic substance particle such as iron and ferrite, and (2) a resin coated carrier composed of a core particle covered with a resin may be used. The above-mentioned resin coated carrier (2) is preferred from the viewpoint of durability thereof.

The volume average particle diameter of the carrier is preferably from 10 to 100 $\mu$m, more preferably 20 to 80 $\mu$m.

The magnetic property of the carrier is preferably from 30 to 80 emu/g in the saturated magnetization.

Iron powder, magnetite and various types of ferrite are usable for the core particle of the resin coated carrier. Among them, magnetite and ferrite are preferred.

A ferrite containing a heavy metal such as copper, zinc, nickel or manganese, and a ferrite containing a light metal such as an alkali metal, for example Li and Na, and/or alkali-earth metal, for example Mg, Ca, Sr and Ba, are preferably used. The light metal-containing ferrite is particularly preferred.

The light metal-containing ferrite has the composition showing the following formula (1) or (2).

(1) $(M_2O)_x(Fe_2O_3)_{1-x}$ (2) $(MO)_x(Fe_2O_3)_{1-x}$

In Formula (1) or (2), M is an alkyl or an alkali-earth metal. Ones may be used, in which a part of $M_2O$ and/or $Fe_2O_3$ is replaced by an alkali-earth metal.

In the Formulas, x is not more than 30 mole-%, preferably not more than 18 mole-%, and the replacing amount of alkali-earth metal and/or alkali metal is preferably from 1 to 15 mole-%, more preferably from 3 to 15 mole-%.

The light metal-containing ferrite and magnetite are preferred since not only problems of pollution caused by the industrial waste can be reduced but the weight of the carrier can be reduced with result of that the stress on the toner can be decreased.

The resin of the resin coated carrier is not specifically limited, and a resin such as a silicone resin, styrene-acryl resin, a vinylidene fluoride and a fluoride resin other than vinylidene fluoride resin are usable.

As the silicone resin, a condensation reactive type silicone resin is preferably used, which is hardened by a heat dehydration condensation reaction or a room temperature moisture hardening reaction. A condensation reactive type silicone resin capable of hardening by the following reaction a or b is particularly preferable.

a: Heat dehydration condensation reaction

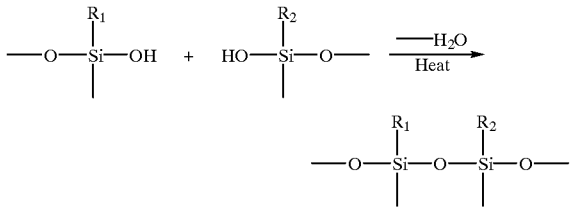

b: Room temperature moisture reaction

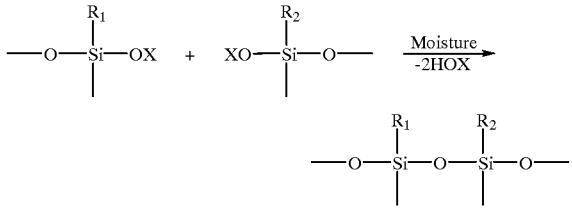

In the above reaction formulas, $R_1$ and $R_2$ are each a substituent such as an alkyl group, and OX is an alkoxy group or an acyloxy group.

Among them, ones in which the substituent is a methoxy group are suitable for producing a carrier having a high durability since a dense coating layer is formed thereby.

Examples of silicone resin preferably usable in the invention include SR-2411 and SR-2710, manufactured by Toray Silicone co., Ltd., and KR-255 and KR-271, manufactured by Shin'etsu Kagaku Co., Ltd.

Examples of the styrene-acryl resin include copolymers of styrene or a styrene derivative such as styrene, o-methylstyrene, m-methylstyrene, p-methylstyrene, $\alpha$-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene and p-n-dodecylstyrene with a methacrylic acid ester derivative such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, and diethylaminoethyl methacrylate, or an acrylic acid ester derivative such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, dimethylaminoethyl acrylate and diethylaminoethyl acrylate, are usable. The content of styrene or its derivative is preferably from 20 to 90% by weight from the view point of the improvement in the durability.

As the vinylidene fluoride resin, a copolymer of vinylidene fluoride and tetrafluoroethylene, hexafluoropropylene, monochlorotrifluoroethylene, monofluoroethylene or trifluoroethylene and another copolymer component is preferred, and ones containing vinylidene fluoride in a ratio of not less than 20% by weight is particularly preferred.

The copolymer component of the vinylidene fluoride other than the halogen-containing monomer includes copolymers of stylene and its derivative such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-butylstyrene, p-n-hexylstyrene, p-n-octylstyrene, p-n-nonylstyrene, p-n-decylstyrene and p-n-dodecylstyrene, with a methacrylic acid ester derivative such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate, and/or an acrylic acid ester derivative such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, dimethylaminoethyl acrylate and diethylaminoethyl acrylate.

The fluorine-containing resin other than vinylidene fluoride includes a resin derived from a compound represented by the following Formula (3).

Formula (3)

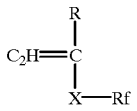

In the formula, R is a hydrogen atom or a methyl group, X is an oxygen atom, a —COO group or a ═CO group, and Rf is a fluoroalkyl group.

The following method can be applied for coating the resin on the core particle; (1) a solution of the resin is sprayed to the core particle and dried, (2) particles of the coating resin is electrostatically adhered to the core particle and mechanical energy is applied thereon to form a coating layer, (3) particles of the coating resin is electrostatically adhered to the core particle and the core particle is heated at a temperature higher than the melting point of the resin to form a coating resin layer, (4) the core particle is immersed in a solution of the resin, and (5) the resin containing a hardener is coated on the core particle and heated to harden the resin layer.

The amount of the coated resin may be an amount sufficient for uniformly covering the core particle surface, and concretely from 0.1 to 5.0%, preferably from 0.5 to 3.0%, by weight of the core particles. The effect of the resin coating cannot be obtained when the coated amount is too low, and an image defect tends to be caused by the resin peeled from the core surface when the coated amount of resin is excessive.

Image Forming Method

In the image forming method using the toner of the invention, it is preferable that the toner remained on the photoreceptor is recovered by a cleaning device and the recovered toner is returned to a developing device or a toner supplying device to reuse the toner.

EXAMPLES

Examples of the invention are described below. Example of a carrier preparation

A raw composition of carrier composed of 1000 parts by weight of ferrite particles, as the core particles, having a volume average diameter of 70 μm and 20 parts by weight of 1,1,1-trifluoroethyl methacrylate powder, as the resin powder, having a volume average diameter of 0.1 μm was put into a horizontal rotation impeller mixer. Then the mixture was heated to 70° C. while stirring with an impeller circumference speed of 4 m/sec. The mixture was further stirred for 20 minutes to prepare a carrier.

Example 1

A raw composition of toner composed of 1000 parts by weight of polyester resin, as the binder resin, 10 parts by weight of carbon black as the colorant, and 3 parts by weight of low molecular weight polypropylene as the mold releasing agent was preliminary mixed by a Henschel mixer for 5 minutes. The mixing conditions were adjusted so that the bulk density and the particle diameter distribution of the toner particles were made as shown in Table 1 and Table 2, respectively. The low molecular weight polypropylene had a shape of ellipsoid having an elliptical ratio of projection image of 0.66, a particle diameter of 0.7 μm, Mw of 6600, Mn of 3000, Mw/Mn of 2.20 and a melting point of 80° C. The mixture was molten and kneaded by a biaxial kneading extruder set at 170° C. Then the mixture was roughly crushed by a hammer mill and finely crushed by a jet crusher, and classified by a wind classification machine to prepare colored particles (A) having a volume average diameter of 10.0 μm were obtained.

To 100 parts by weight of the colored particles (A) thus obtained, 1 part by weight of hydrophobic silica was externally added and mix by a Henschel mixer with a stirring speed of 40 m/sec for 20 minutes at 37° C. Thus Toner (A) according to the invention was obtained, which has the properties shown in Table 3.

Example 2

A raw composition of toner composed of 100 parts by weight of polyester resin, as the binder resin, 10 parts by weight of carbon black, as the colorant, and 4 parts by weight of low molecular weight polypropylene, as the mold releasing agent, was preliminary mixing by a Loedige mixer (crushing blade: ON) for 5 minutes. The mixing conditions were adjusted so that the toner has the bulk density shown in Table 1 and the particle diameter distribution shown in Table 2. The low molecular weight polypropylene had a shape of ellipsoid having an elliptical ratio of projection image of 0.31, a particle diameter of 0.8 μm, Mw of 13700, Mn of 7200, Mw/Mn of 1.90 and a melting point of 133° C. The mixture was molten and kneaded by a biaxial kneading extruder set at 170° C. Then the mixture was roughly crushed by a hammer mill and finely crushed by a jet crusher, and classified by as wind classification machine to prepare colored particles (B) having a volume average diameter of 9.0 μm were obtained.

To 100 parts by weight of the colored particles (B) thus obtained, 1 part by weight of hydrophobic silica was externally added and mix by a Henschel mixer with a stirring speed of 40 m/sec for 20 minutes at 37° C. Thus Toner (B) according to the invention was obtained, which has the properties shown in Table 3.

Example 3

A raw composition of toner composed of 100 parts by weight of styrene-acryl resin, as the binder resin, 10 parts by weight of carbon black, as the colorant, and 4 parts by weight of low molecular weight polypropylene, as the mold releasing agent, was preliminary mixing by a Herschel mixer for 5 minutes. The mixing conditions were adjusted so that the toner has the bulk density shown in Table 1 and the particle diameter distribution shown in Table 2. The low molecular weight polypropylene had a shape of ellipsoid having an elliptical ratio of projection image of 0.55, a particle diameter of 1.0 pim, Mw of 13700, Mn of 7200, Mw/Mn of 1.90 and a melting point of 133° C. The mixture was molten and kneaded by a biaxial kneading extruder set at 170° C. Then the mixture was roughly crushed by a hammer mill and finely crushed by a jet crusher, and classified by as wind classification machine to prepare colored particles (C) having a volume average diameter of 8.0 μm were obtained.

To 100 parts by weight of the colored particles (B) thus obtained, 1 part by weight of hydrophobic silica was externally added and mix by a Henschel mixer with a stirring speed of 40 m/sec for 20 minutes at 37° C. Thus Toner (C) according to the invention was obtained, which has the properties shown in Table 3.

Comparative Example 1

A raw composition of toner composed of 100 parts by weight of polyester resin, as the binder resin, 10 parts by weight of carbon black, as the colorant, and 4 parts by weight of low molecular weight polypropylene, as the mold releasing agent, was preliminary mixing by a Loedige mixer (crushing wing ON) for 5 minutes. The mixing conditions were adjusted so that the bulk density shown in Table 1 and the particle diameter distribution shown in Table 2 were obtained. The low molecular weight polypropylene had a sphere shape, a particle diameter of 100 pm, Mw of 8600, Mn of 2270, Mw/Mn of 3.79 and a melting point of 135° C. The mixture was molten and kneaded by a biaxial kneading extruder set at 170° C. Then the mixture was roughly crushed by a hammer mill and finely crushed by a jet crusher, and classified by as wind classification machine to prepare comparative colored particles (a) having a volume average diameter of 10.0 μm were obtained.

To 100 parts by weight of the comparative colored particles (a) thus obtained, 1 part by weight of hydrophobic silica was externally added and mix by a Henschel mixer with a stirring speed of 25 m/sec for 15 minutes at 17° C. Thus Toner (a) according to the invention was obtained, which has the properties shown in Table 3.

Comparative Examples 2 and 3

Comparative colored particles (b) and (c) were prepared in the same manner as in comparative toner (a) except that the mixing conditions were changed so that the bulk density shown in Table 1 and the particle diameter distribution shown in Table 2 were obtained. The comparative colored particles (b) and (c) each had a volume average diameter of 10.0 μm. Then comparative toners (b) and (c) having the properties shown in Table 3 were prepared using the comparative colored particles (b) and (c), respectively.

TABLE 1

| | Bulk density (g/cm$^3$) | | |
|---|---|---|---|
| | Mixing time | | Changing ratio |
| | 1 min. | 5 min. | (%) |
| Example 1 | 0.609 | 0.618 | 101.5 |
| Example 2 | 0.589 | 0.592 | 100.5 |
| Example 3 | 0.556 | 0.575 | 103.4 |
| Comparative example 1 | 0.651 | 0.650 | 99.8 |
| Comparative example 2 | 0.610 | 0.609 | 99.8 |
| Comparative example 3 | 0.596 | 0.594 | 99.7 |

TABLE 2

| | Particle diameter distribution (%) | | | | | | | | | |
|---|---|---|---|---|---|---|---|---|---|---|
| Mesh | Mixing time; 1 min. | | | | | Mixing time; 5 min. | | | | |
| (μm) | 250 | 150 | 75 | 45 | 20 | 250 | 150 | 75 | 45 | 20 |
| Ex. 1 | 59.0 | 18.8 | 20.9 | 1.2 | 0.1 | 56.2 | 15.7 | 24.9 | 3.1 | 0 |
| Ex. 2 | 61.4 | 17.0 | 18.4 | 3.1 | 0.1 | 62.9 | 12.3 | 16.4 | 8.1 | 0.2 |
| Ex. 3 | 59.9 | 17.3 | 19.5 | 3.2 | 0.1 | 59.5 | 18.1 | 20.5 | 1.8 | 0 |
| Comp. Ex. 1 | 68.8 | 14.5 | 12.4 | 4.1 | 0.1 | 70.9 | 14.5 | 9.8 | 4.5 | 0.3 |
| Comp. Ex. 2 | 70.9 | 15.5 | 10.4 | 3.1 | 0.1 | 70.1 | 15.2 | 11.2 | 3.4 | 0.1 |
| Comp. Ex. 3 | 69.6 | 16.5 | 11.1 | 2.7 | 0.1 | 69.5 | 16.5 | 11.1 | 2.8 | 0.1 |

TABLE 3

| | Toner | Polypropylene content (Parts by weight) | Free polypropylene index by centrifugal separation | Free polypropylene index by natural precipitation | Ratio of free polypropylene particle of diameter of not more than 4 μm (number %) | Ratio of free polypropylene particle of elliptical ratio of not more than 0.8 (number %) |
|---|---|---|---|---|---|---|
| Ex. 1 | A | 3 | 0.25 | 0.01 | 65 | 70 |
| Ex. 2 | B | 4 | 0.61 | 0.02 | 55 | 60 |
| Ex. 3 | C | 4 | 0.12 | 0.04 | 75 | 55 |
| Comp. Ex. 1 | a | 4 | 0.89 | 0.12 | 45 | 45 |
| Comp. Ex. 2 | b | 4 | 0.96 | 0.18 | 86 | 14 |
| Comp. Ex. 3 | c | 4 | 1.80 | 0.26 | 37 | 43 |

Preparation Example of Developer

Toners for evaluation were prepared by mixing the toner of the invention (A), (B) or (C), or the comparative toner (a), (b) or (c) was mixed with the carrier so that the ratio of the toner to the carrier was made to 5% by weight.

Evaluation by actual photographing

An original picture having a blackened area ratio of 5% was copied by an electrophotographic copying machine Konica 2125 under conditions of high temperature at 33° C. and high moisture at relative humidity of 80%. Konica 2125 was previously modified so as to change the cleaning blade load to 18.6 g/cm. The test results were evaluated regarding the following items (1) to (4). Results of evaluation are shown in Table 4.

(1) Toner filming

The number of copied sheet was counted until a band-like contamination in the transporting direction of paper was occurred.

(2) Black spot contamination

The number of copied sheet was counted until 10 black spots contamination having a diameter 0.8 mm or more were formed on the white background area of the copy.

(3) Life of developer

The reflective density of the white background area of the copy sheet was measured by Sakura Densitometer, manufactured by Konica Corp., and the number of copied sheet was counted until the relative reflective density was exceed 0.01. The relative reflective density was determined based on the density of the paper it self of 0.

(4) Transferring ratio

A solid image having a density of 1.3 and the area of 20 mm×50 mm was prepared, and the transferring ratio was calculated by the following equation.

TABLE 4

| | Toner | Occurrence of toner filming | Formation of black spot | Life of developer | Transferring ratio (%) |
|---|---|---|---|---|---|
| Ex. 1 | A | Not occurred until 120,000th sheets | Not formed until 120,000th sheets | 60,000 sheets | 98 |
| Ex. 2 | B | Not occurred until 100,000th sheets | Not formed until 100,000th sheets | 50,000 sheets | 96 |
| Ex. 3 | C | Not occurred until 140,000th sheets | Not formed until 140,000th sheets | 80,000 sheets | 97 |

TABLE 4-continued

| | Toner | Occurrence of toner filming | Formation of black spot | Life of developer | Transferring ratio (%) |
|---|---|---|---|---|---|
| Comp. Ex. 1 | a | Occurred at 20,000th sheets | Formed at 40,000th sheets | 20,000 sheets | 78 |
| Comp. Ex. 2 | b | Occurred at 20,000th sheets | Formed at 80,000th sheets | 20,000 sheets | 79 |
| Comp. Ex. 3 | c | Occurred at 20,000th sheets | Formed at 30,000th sheets | 20,000 sheets | 69 |

As above-described, the off-set problem is prevented and formation of black spot can be inhibited by the toner according to the invention when the toner is used in the image forming process. Furthermore, formation of black spot contamination on the image can be prevented and the life of developer can be prolonged by the use of the toner of the invention.

What is claimed is:

1. A toner for developing an electrostatic image comprising a colored particle containing a binder resin, a colorant, and a low molecular weight polypropylene particle, which has a content of the low molecular weight polypropylene particle of 0.3 to 8.0 percent by weight, a free polypropylene index measured by a centrifugal method of from 0.1 to 0.7 and a free polypropylene index measured by a natural sedimentation method of not more than 0.1.

2. The toner of claim 1 wherein shape of the polypropylene particle separated by the centrifugal method is substantially ellipsoid.

3. The toner of claim 2 wherein a number ratio of ellipsoid polypropylene particles each having an elliptical axis ratio of projection image of not more than 0.8 to the whole number of the separated polypropylene particles is not less than 50 percent.

4. The toner of claim 1 wherein ratio of number of the polypropylene particles separated by centrifugal method having a particle diameter of not more than 4 μm to the whole number of the polypropylene particles separated by the centrifugal method is not less than 50%.

5. The toner of claim 4 wherein ratio of number of the polypropylene particles having a particle diameter of not more than 4 μm to the whole number of the polypropylene particles separated by the centrifugal method is not less than 60%.

6. The toner of claim 1 wherein molecular weight of the low molecular weight polypropylene particle is 1,500 to 10,000, in number average molecular weight Mn.

7. The toner of claim 6 the wherein molecular weight of the low molecular weight polypropylene particle is 1,800 to 4,000, in number average molecular weight Mn.

8. The toner of claim 1 wherein ratio of weight average molecular weight Mw to number average molecular weight Mn of the low molecular weight polypropylene particle Mw/Mn is 1.5 to 3.

9. The toner of claim 8 wherein the ratio of the weight average molecular weight Mw to the number average molecular weight Mn of the low molecular weight polypropylene particle Mw/Mn 2 to 3.

10. The toner of claim 8 wherein content of the low molecular weight polypropylene particles in the toner is 1.3 to 5.7% by weight.

11. The toner of claim 3 wherein ratio of number of the polypropylene particles separated by centrifugal method having a particle diameter of not more than 4 $\mu$m to the whole number of the polypropylene particles separated by the centrifugal method is not less than 50%.

12. The toner of claim 3 wherein the molecular weight of polypropylene particle is 1,500 to 10,000, in number average molecular weight Mn, and ratio of weight average molecular weight Mw to Mn of the polypropylene particles is 1.5 to 3.

13. The toner of claim 1 wherein the colored particles has a volume average particle dimeter of 2 to 10 $\mu$m.

14. The toner of claim 12, further comprising an external additive having number average primary diameter of 5 to 20 nm.

15. The toner of claim 12, comprising a free polypropylene index measured by centrifugal method of 0.1 to 0.4.

16. The toner of claim 15, comprising a free polypropylene index measured by a natural sedimentation is not more than 0.05.

17. A developer for developing an electrostatic image comprising a toner of claim 1.

18. The developer of claim 17, further comprising a carrier.

* * * * *

UNITED STATES PATENT AND TRADEMARK OFFICE

CERTIFICATE OF CORRECTION

PATENT NO. : 6,228,551 B1
DATED : May 8, 2001
INVENTOR(S) : Ohmura et al.

It is certified that error appears in the above-identified patent and that said Letters Patent is hereby corrected as shown below:

Column 13,
Lines 33 and 43, after "copied" delete "sheet" and insert therefor -- sheets --
Line 34, after "paper" delete "was" and insert therefor -- had --
Line 38, after "spots" insert therefor -- of --
Line 44, after "density" delete "was exceed" and insert therefor -- exceeded --
Line 46, after "paper" delete "it self" and insert therefor -- itself --
Line 50, after "equation" and before "TABLE 4" insert therefor -- Transferring ration (%) =

$$\frac{\text{Toner weight transferred on the sheet}}{\text{Toner weight developed on the photoreceptor}} \times 100 \text{ --}$$

Column 15,
Line 1, after "claim 6" delete "the wherein" and insert therefor -- wherein the --

Column 16,
Line 5, after "particle" delete "dimeter" and insert therefor -- diameter --

Signed and Sealed this

Fourth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,228,551 B1
DATED : May 8, 2001
INVENTOR(S) : Ohmura et al.

It is certified that error appears in the above-identified patent and that said Letters Patent is hereby corrected as shown below:

Column 2,
Line 35, after “detail” delete “bellow.” and insert -- below. --.

Column 3,
Line 38, after “since” delete “of”.
Line 53, after “toner” delete “is become” and insert -- becomes --.

Column 4,
Line 19, after “titanate” insert -- , --.

Column 5,
Line 18, after “and” delete “the” and insert -- then --.
Line 31, after “liquid” delete “is stood” and insert -- stands --.
Line 39, after “liquid” insert -- is --.
Line 40, after “procedures” delete “(I)” and insert -- (i) --.
Line 49, before “and” delete “put,” and insert -- placed --.
Line 55, after “suspension” delete “is stood” and insert -- stands --.

Column 6,
Line 6, after “having” delete “a” and insert -- an --.
Line 14, after “to” delete “obtained” and insert -- obtain --.
Line 44, after “polypropylene” delete “particle” and insert -- particles --.

Column 7,
Line 25, after “having” delete “a” and insert -- an --.
Line 32, after “diameter” delete “on” and insert -- of --.
Line 42, after “both” delete “of”.

Column 8,
Line 23, in reaction a formulation, delete “—— $H_20$” and insert -- - $H_20$ --.
Line 49, after “Silicone” delete “co.” and insert -- Co. --.

Column 9,
Line 48, before “electrostatically” delete “is” and insert -- are --.
Line 50, after “resin” delete “is” and insert -- are --.
Line 67, after “toner” delete “remained” and insert -- remaining --.

Column 10,
Line 24, after “was” delete “preliminary” and insert -- preliminarily --.
Lines 40 and 67, after “and” delete “mix” and insert -- mixed --.

UNITED STATES PATENT AND TRADEMARK OFFICE

CERTIFICATE OF CORRECTION

PATENT NO. : 6,228,551 B1
DATED : May 8, 2001
INVENTOR(S) : Ohmura et al.

It is certified that error appears in the above-identified patent and that said Letters Patent is hereby corrected as shown below:

Column 10 (cont'd),
Line 51, after "was" delete "preliminary mixing" and insert -- preliminarily mixed --.
Line 62, after "by" delete "as" and insert -- a --.

Column 11,
Line 10, after "was" delete "preliminary mixing" and insert -- preliminary mixed --.
Line 16, after "1.0" delete "pim" and insert -- µm --.
Line 21, after "by" delete "as" and insert -- a --.
Line 26, after "and" delete "mix" and insert -- mixed --.
Line 37, after "was" delete "preliminary mixing" and insert -- preliminarily mixed --.
Line 42, after "100" delete "pm" and insert -- µm --.

Column 12,
Line 2, after "by" delete "as" and insert -- a --.
Line 9, after "and" delete "mix" and insert -- mixed --.

Column 13,
Lines 33 and 43, after "copied" delete "sheet" and insert -- sheets --.
Line 34, after "paper" delete "was" and insert -- had --.
Line 38, after "spots" insert -- of --.
Line 44, after "density" delete "was exceed" and insert -- exceeded --.
Line 46, after "paper" delete "it self" and insert -- itself --.
Line 50, after "equation" and before "TABLE 4" insert -- Transferring ration (%) =

$$\frac{\text{Toner weight transferred on the sheet}}{\text{Toner weight developed on the photoreceptor}} \times 100$$ --

Column 15,
Line 1, after "claim 6" delete "the wherein" and insert -- wherein the --.

Column 16,
Line 5, after "particle" delete "dimeter" and insert -- diameter --.

UNITED STATES PATENT AND TRADEMARK OFFICE

CERTIFICATE OF CORRECTION

PATENT NO. : 6,228,551 B1
DATED : May 8, 2001
INVENTOR(S) : Ohmura et al.

It is certified that error appears in the above-identified patent and that said Letters Patent is hereby corrected as shown below:

Column 16,
Line 5, after "particle" delete "dimeter" and insert therefor -- diameter --.

This certificate supersedes Certificate of Correction issued January 4, 2005.

Signed and Sealed this

Twenty-fifth Day of April, 2006

JON W. DUDAS
*Director of the United States Patent and Trademark Office*